United States Patent [19]

Goldstein et al.

[11] Patent Number: 4,906,178

[45] Date of Patent: Mar. 6, 1990

[54] SELF-POWERED GAS APPLIANCE

[75] Inventors: Mark K. Goldstein, La Jolla; Earl M. Dolnick, Encinitas; John C. Bass, La Jolla, all of Calif.

[73] Assignee: Quantum Group, Inc., San Diego, Calif.

[21] Appl. No.: 216,286

[22] Filed: Jul. 6, 1988

Related U.S. Application Data

[63] Continuation-in-part of Ser. No. 864,088, May 16, 1986, abandoned, and a continuation-in-part of Ser. No. 48,961, May 11, 1987, Pat. No. 4,793,799, which is a continuation of Ser. No. 659,074, Oct. 5, 1984, abandoned, which is a continuation-in-part of Ser. No. 517,699, Jul. 25, 1983, abandoned.

[51] Int. Cl.[4] ..... F23N 5/08

[52] U.S. Cl. ..... 431/79; 431/12; 431/328; 126/351; 126/110 C; 126/116 A; 126/101

[58] Field of Search ..... 431/79, 12, 78, 326, 431/328, 329; 340/577, 570; 250/363 R, 364, 368, 369, 379, 393, 554; 361/173, 175, 176; 126/351, 110 C, 110 R, 116 A, 101; 122/448 R

[56] References Cited

U.S. PATENT DOCUMENTS

| | | |
|---|---|---|
| 2,306,073 | 12/1942 | Metcalf . |
| 2,351,277 | 6/1944 | Mantz . |
| 2,531,592 | 11/1950 | Yant et al. . |
| 2,549,974 | 4/1951 | Klug . |
| 2,553,179 | 5/1951 | Farr et al. . |
| 2,561,802 | 7/1951 | Klug . |
| 2,748,846 | 6/1956 | Smith et al. . |
| 2,835,886 | 5/1958 | Bogdanowski et al. . |
| 2,898,981 | 8/1959 | Westbrook . |
| 3,037,554 | 6/1962 | Risse . |
| 3,086,147 | 4/1963 | Pounds . |
| 3,102,257 | 8/1963 | Miller . |

(List continued on next page.)

FOREIGN PATENT DOCUMENTS

| | | |
|---|---|---|
| 0120203 | 3/1983 | European Pat. Off. . |
| 0101086 | 2/1984 | European Pat. Off. . |
| 0139434 | 3/1984 | European Pat. Off. . |
| 690479 | 4/1940 | Fed. Rep. of Germany . |
| 1189734 | 11/1965 | Fed. Rep. of Germany . |
| 2152384 | 4/1973 | Fed. Rep. of Germany . |
| 2518264 | 4/1976 | Fed. Rep. of Germany . |
| 3203477 | 11/1983 | Fed. Rep. of Germany . |
| 2235609 | 6/1973 | France . |
| 2356883 | 1/1978 | France . |
| 992102 | 5/1965 | United Kingdom . |
| 2025725 | 1/1981 | United Kingdom . |

OTHER PUBLICATIONS

Guzzoni, High Temperature Spectral Emittance of Oxides of Erbium, Samarium, Neodymium and Ytterbium, Jun. 18, 1972, *Applied Spectroscopy*, pp. 60 to 65.

Electronics, vol. 52, No. 19, Sep. 13, 1979, p. 130; New York, U.S.—G. J. Millard: "Solar-Powered Regulator Charges Batteries Efficiently".

*Primary Examiner*—Randall L. Green

*Attorney, Agent, or Firm*—Christie, Parker & Hale

[57] ABSTRACT

Embodiments of gas-fired appliances which generate sufficient electricity to be self-powered include water heaters, space heaters, air conditioning units, and electric power and steam cogeneration systems. In such apparatus, gas is burned in a porous ceramic surface combustion burner. The high temperature surface of the burner includes a narrow band quantum emitting substance such as a rare earth metal oxide and preferably ytterbium oxide. Relatively shorter wavelength radiation from this quantum emitting surface illuminates photovoltaic cells having an absorption spectrum matched to the emission spectrum of the burner surface for generating sufficient electricity for powering the appliance. An infrared absorbing filter removes relatively longer wavelength radiation which would otherwise heat the photovoltaic cells. The cells are cooled, preferably by a portion of the utility fluid heated by the appliance. This enhances both the thermal efficiency of the appliance and the photovoltaic conversion efficiency of the cells.

25 Claims, 10 Drawing Sheets

U.S. PATENT DOCUMENTS 3,114,610 12/1963 Gafford et al. .
3,188,836 6/1965 Kniebes .
3,238,423 3/1966 Giuffrida .
3,301,308 1/1967 Briggs .
3,304,989 2/1967 Alexander et al. .
3,331,707 7/1967 Werth .
3,537,804 11/1970 Walbridge .
3,576,556 4/1971 Sellors .
3,754,867 8/1973 Guenther .
3,765,820 10/1973 Ito .
3,820,097 6/1974 Larson .
3,943,705 3/1976 DeCorso et al. .
4,043,934 8/1977 Shuler .
4,059,385 11/1977 Gulitz et al. .
4,370,557 1/1983 Axmark et al. .
4,405,299 9/1983 Serber .
4,415,264 11/1983 Wittmer .
4,584,426 4/1986 Nelson .
4,633,029 12/1986 Tillett, Jr. et al. .
4,639,542 1/1987 Bass et al. .

SELF-POWERED GAS APPLIANCE

CROSS REFERENCE TO RELATED APPLICATIONS AND DISCLOSURE DOCUMENTS

This application is a continuation-in-part of U.S. patent application Ser. No. 864,088 filed May 16, 1986 (now abandoned). It is also a continuation-in-part of U.S. patent application Ser. No. 48,961 filed May 11, 1987, now U.S. Pat. No. 4,793,799, which is a continuation of U.S. patent application Ser. No. 659,074 filed Oct. 5, 1984, (now abandoned) which was a National application corresponding to International Application No. PCT/US84/01038 filed July 3, 1984, which was a continuation-in-part claiming priority of U.S. patent application Ser. No. 517,699 filed July 25, 1983 (now abandoned).

The application is also related to Disclosure Document Ser. No. 156,490 filed on or about Sept. 22, 1986, and Disclosure Document Ser. No. 167,739 filed Apr. 13, 1987, and apparently renumbered by the U.S. Patent and Trademark Office as Disclosure Document Ser. No. 168,234. The subject matter set forth in these prior applications and disclosure documents is hereby incorporated by reference.

BACKGROUND OF THE INVENTION

This invention relates to a cogeneration system where a gas water heater, furnace, or the like includes photovoltaic means for generating electricity for powering its own blowers, ignition devices, and the like, and even including generating more power than required for its own operation for use in other devices.

Gas-fired water heaters are rarely provided with electric power. Thus they are essentially gravity devices with convective circulation of combustion products and water. It would sometimes be desirable to augment circulation with electric blowers. It would also be desirable to have automatic electric ignition rather than a standing pilot for minimizing fuel consumption.

A completely gas water heater which generates its own electricity can replace electric water heaters in building situations in which gas water heaters must have power vents. These situations occur where the cost of installing vertical roof vents is high and the only means of venting is through an external wall. In such cases the cost of the power vent and associated vent safety systems may be prohibitive, and electric heaters are installed because the initial installation is less costly. With a self-powered gas-fired water heater the more economical gas fuel can be used.

Gas-fired furnaces for space heating are commonly connected to electric power for operating the system's blowers, and in more recent furnaces to provide intermittent ignition rather than having a standing pilot flame continuously burning. Overall fuel economy may be promoted by providing the blower with electric power cogenerated with the space heating provided by the furnace.

Thermocouples have long been used in gas-powered appliances for generating a small amount of electric current. Typically a thermocouple is placed in the pilot flame to generate just enough power to keep a fuel control valve open. This operates as a safety precaution so that the absence of power from the thermocouple cuts off the flow of fuel. There is insufficient power from such a thermocouple for opening such a valve, which is commonly reset manually, let alone operate a blower or auxiliary devices.

Electric power can also be generated by photovoltaic devices. U.S. Pat. No. 3,188,836 by Kniebes describes use of emissive radiation to generate power to control a valve for a gas lamp. This was, in effect, a replacement for a thermocouple.

Rather different technology involves use of photoelectric devices which change resistance, for example, when illuminated. These devices, in effect, act as switches for controlling current from sources of electric power. These systems are not self powered since the photoelectric devices do not generate electricity. Exemplary of use of photoelectric devices in appliance control can be seen in U.S. Pat. No. 2,306,073 by Werth.

U.S. Pat. No. 3,331,701 by Werth provides the first known description of a thermophotovoltaic power producing device using silicon cells. The efficiency of silicon solar cells has been optimized to produce electric power with an efficiency of about 26% using a tungsten filament heated to about 2200° K. as the heat source. This would be no more than marginally suitable for a self-powered gas fired appliance as provided in practice of this invention.

It is therefore desirable to provide a highly efficient means for generating electric power in a gas-fired appliance so that blowers and other auxiliary electric devices can be operated entirely by power generated by the gas-fired appliance. Such cogeneration of electric power and a heated utility fluid, such as in a hot water heater or space heater, can provide high thermal efficiency.

BRIEF SUMMARY OF THE INVENTION

There is therefore provided in practice of this invention according to a presently preferred embodiment, a completely self-powered gas appliance such as a natural gas fired water heater or space heater. In this appliance a gas burner has an emissive surface which includes a substance that emits quantum radiation when thermally stimulated. An exemplary thermally stimulated quantum emitter comprises a rare earth metal oxide such as ytterbium oxide. A blower supplies combustion air to the burner for burning a fuel gas and heating the emissive surface. Photovoltaic cells convert radiation from the emissive surface into electric power which operates the blower. Electric power may be used for other purposes such as control and ignition. Further, heat from the combustion products is transferred to a utility fluid such as water or air.

Preferably, the utility fluid is also used for removing heat from the photovoltaic cells for utilizing heat otherwise wasted and increasing the efficiency of the photovoltaic cells. If desired, a band pass filter can be provided between the emissive surface and the photovoltaic cells for removing long wavelength radiation which would heat the cells and permitting only the shorter wavelength radiation to pass, which is converted efficiently to electricity. Such efficiency is enhanced by matching the absorption spectrum of the photovoltaic cells to the emission spectrum of the thermally stimulated quantum emitter. With ytterbium oxide as the emitter, a suitable photovoltaic cell comprises copper indium diselenide.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Figure 1:
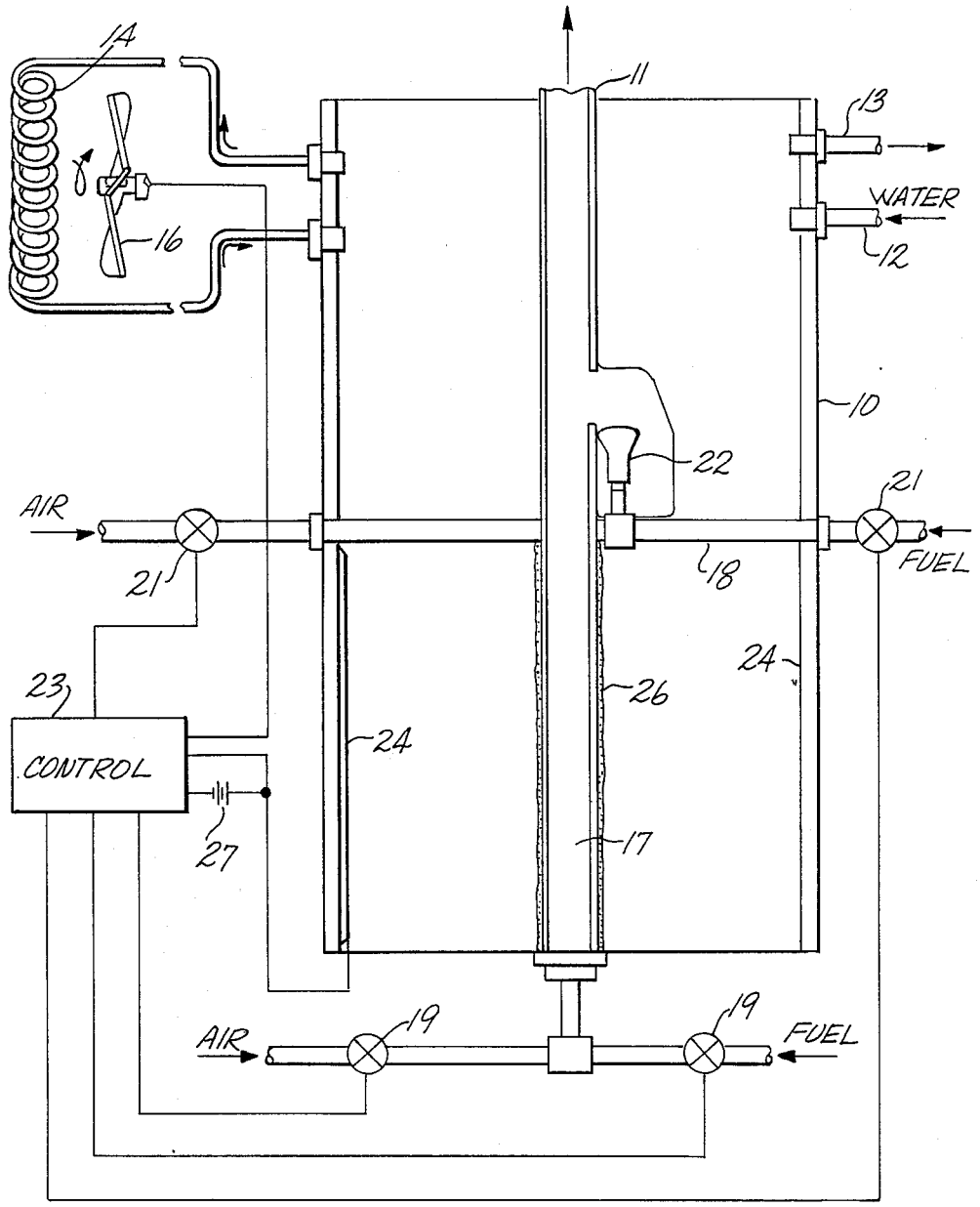
FIG. 1 illustrates semi-schematically and in block diagram a simple water heater constructed according to principles of this invention.

FIG. 1 illustrates schematically a representative water heating system which has its electric power requirements supplied by the combustion of the fuel which also serves to heat the water. A hot water tank 10 or similar vessel has its water heated by combustion products exiting through a vent 11. Water is introduced into the tank through a cold water pipe 12 and hot water can be withdrawn through an outlet 13 for culinary purposes or the like. Alternatively, or in addition, water can be circulated through an external heat exchange loop 14 which may be cooled by a fan 16 for space heating. Such an external loop may involve pumped flow or may be a gravity system.

Combustion occurs in a tube 17 in a separate chamber below a bulkhead 18, thereby producing the combustion product gases which pass up the vent 11. The burner is powered by air and fuel introduced through suitably controlled valves 19. Separate solenoid valves 1 control flow of fuel and air to a pilot burner 22 for igniting combustion in the main burner tube 17. The valves are controlled by a microprocessor-based control system 23 which is electrically connected to the several valves.

The interior wall of the lower chamber is lined with photovoltaic cells 24 which are illuminated by radiation from an emissive surface 26 on the combustion tube. Electric power from the photovoltaic cells operates the control system 23 as well as providing power for the valves and the fan 16. A rechargeable battery 27 is provided in the system for start-up when there is no combustion and hence no power directly from the photovoltaic cells. The battery is recharged by power from the cells after start-up. It will be recognized that the electrical system is indicated only schematically and may include additional elements.

Figure 2:
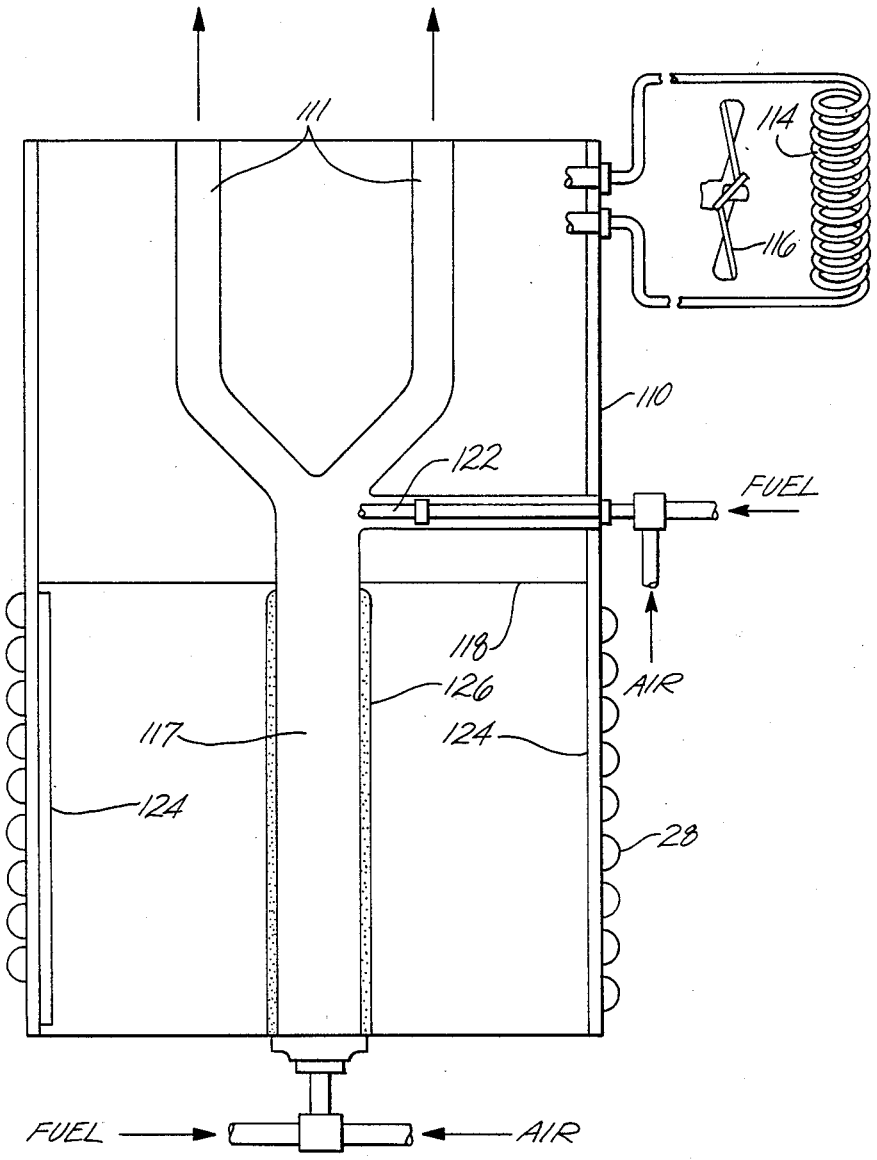
FIG. 2 illustrates another embodiment of cogeneration water heater.

A generally similar arrangement is illustrated in FIG. 2, in which like parts are identified by reference numerals 100 greater than the reference numeral identifying the same part in FIG. 1. Thus, for example, the pilot burner 122 in FIG. 2 corresponds to the pilot burner 22 in FIG. 1.

The arrangement illustrated in FIG. 2 has an additional feature, namely water cooling coils 28 wrapped around the lower chamber for withdrawing heat from the photovoltaic cells 124 on its internal wall. Cold water passing through the coils keeps the temperature of the photovoltaic cells low for enhancing their conversion efficiency. This arrangement enhances the overall thermal efficiency of the system since the water from the cooling coils is then introduced into the water tank 110, thereby conserving heat that would otherwise be dissipated from the photovoltaic cells. Thus, the cooling water enhances both thermal and electrical conversion efficiency, thereby significantly enhancing the overall efficiency of the cogeneration water heater.

Figure 3:
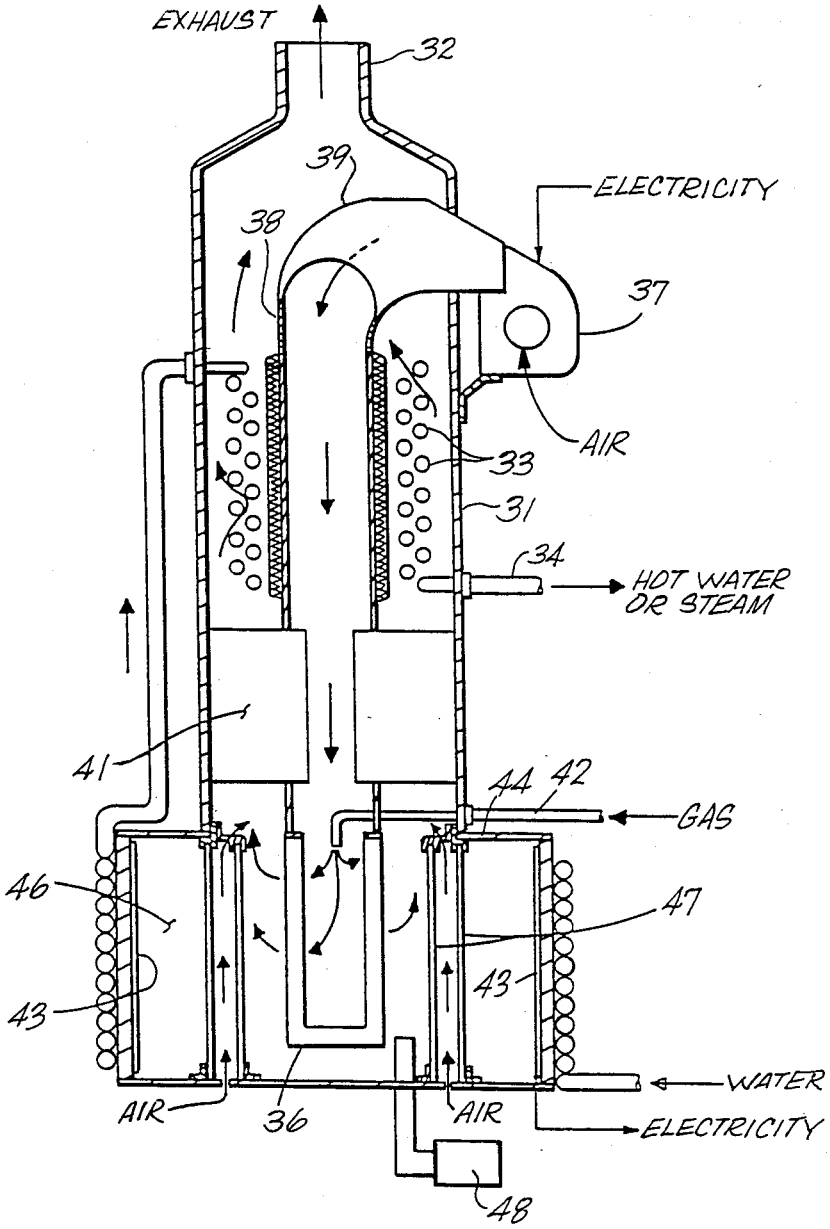
FIG. 3 illustrates in greater detail a cogeneration appliance for producing hot water or steam as well as electricity.

FIG. 3 illustrates in somewhat greater detail, albeit still schematically, a combined thermophotovoltaic power generator and water heating system constructed according to principles of this invention. In this embodiment exhaust gases are contained in a shell 31 before leaving the system through an exhaust vent 32. A heat exchange coil 33 receives heat from the hot exhaust gases and produces hot water or steam by way of an outlet conduit 34. It will be apparent that collateral aspects of such a system such as thermal insulation on the shell have been omitted from this illustration.

The exhaust gases rise from a porous ceramic surface combustion burner 36 at the lower part of the apparatus. Combustion air is introduced to the surface combustion burner by way of a blower 37 connected to an axial tube 38 in the shell by a duct 39. The air passes downwardly countercurrent to the exhaust gases through a finned heat exchanger 41. This heat exchanger transfers heat from the hot exhaust gases and preheats the combustion air. Such a heat exchanger can be provided upstream and/or downstream from the water heating coil as may prove more efficient for desired power generation, heat transfer and outlet water temperature. Fuel gas is introduced into the porous surface combustion burner by way of a conduit 42.

The surface combustion burner is described in greater detail hereinafter. Suffice it to say that combustion occurs within the body of the burner, thereby heating at least its outer surface to a sufficient temperature to emit radiation at a sufficiently short wavelength for efficient absorption by photovoltaic cells.

Thus, radiation from the surface of the burner illuminates photovoltaic cells 43 around the walls of a lower chamber 44. A water cooling coil 49 around the wall of the lower chamber cools the photovoltaic cells, and as in the embodiment in FIG. 2, provides pre-heated water for the system.

The lower chamber 44 is divided into a central portion and an annular space 46 by concentric quartz or glass tubes 47 between the surface combustion burner 36 and the photovoltaic cells. It is desirable that the annular space 46 between the outer glass tube and the photovoltaic cells be filled with an inert gas. Cooling air passes upwardly between the tubes, and at the top commingles with the combustion products. The cooling air can be either aspirated by the combustion products or be circulated by a blower (not shown).

A high voltage spark igniter system 48 is provided near the surface combustion burner for igniting combustion.

The quartz and/or glass tubes between the burner and photovoltaic cells act as a band pass filter for radiation from the emissive surface of the burner. The cells are effective in absorbing relatively short wavelength radiation and converting it to electricity. Relatively longer wavelength radiation is also absorbed but only generates heat. The band pass filter provided by the tubes passes a major part of the relatively shorter wavelength radiation to the photovoltaic cells and removes a significant portion of the longer wavelength radiation which would otherwise heat the cells. The radiation absorbed in the tubes is then removed by the cooling air flowing therebetween. This heat is also recovered in the system since the air commingles with the exhaust gas and such heat may be transferred to the incoming air or the water being heated.

In this embodiment the drawing only illustrates an output of electricity from the photovoltaic cells and use of electricity for the air blower. The interconnection of these, and electricity for the igniter, may be as illustrated in FIG. 2. This apparatus, however, may be employed as a cogeneration device for producing an excess of electricity over the needs of the apparatus itself.

The cogeneration device may be tailored to a specific application by sizing the regenerative heat exchanger 41. The ratio of electric to thermal power produced by the system also depends on the amount of inlet air bypassed between the quartz tubes and the relative size of the regenerative heat exchanger. Fine control of the ratio of electric to thermal power may be obtained by varying the amount of air bypassed between the quartz tubes by a control valve (not shown).

The amount of heat energy deposited in the water cooling of the photovoltaic cells depends to a large extent on the amount of long wavelength infrared energy absorbed by the quartz tubes. The total energy produced may be set by adjusting the fuel and air rates. It should be noted that the sizing of the regenerative heat exchanger in relation to the gas flow is such that the incoming air is heated until its temperature is somewhat below the air/fuel auto ignition temperature, thereby assuring that combustion occurs in the porous burner.

Figure 4:
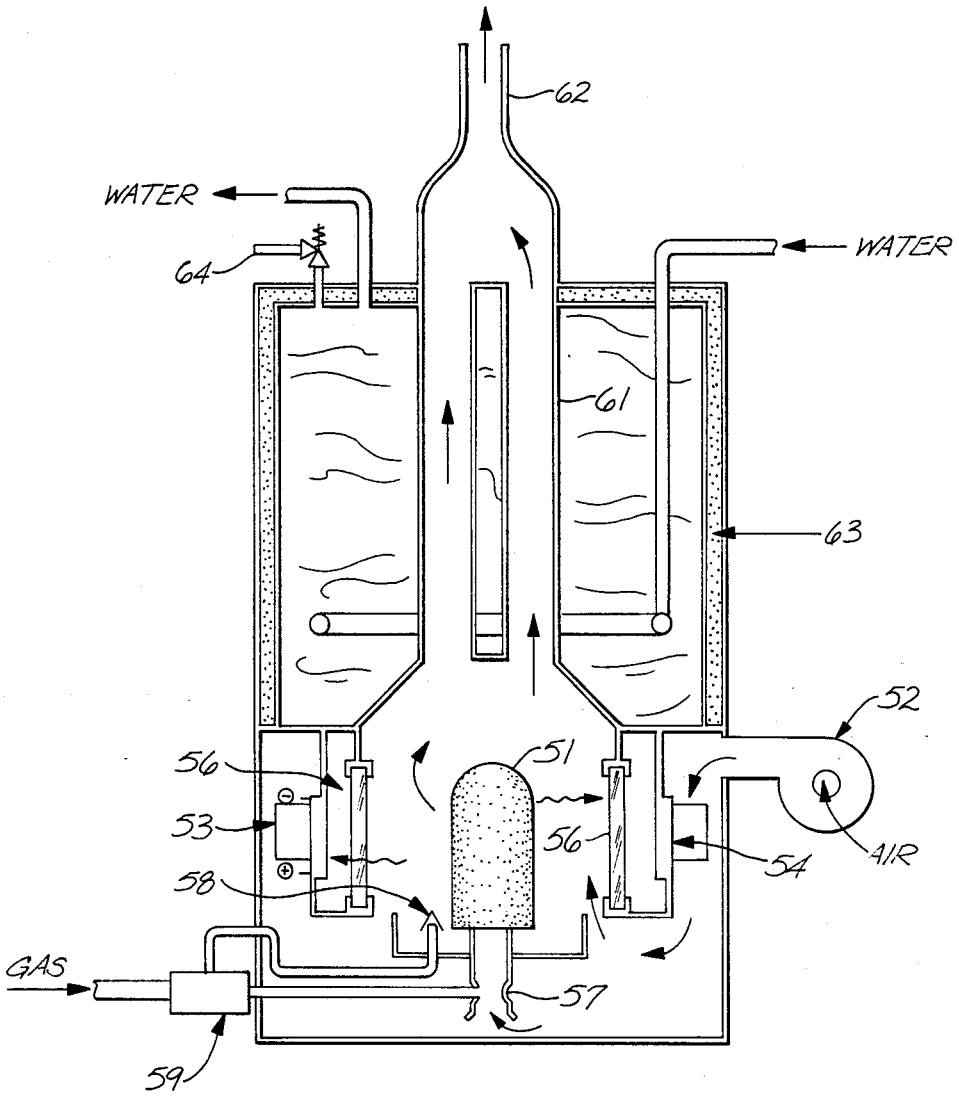
FIG. 4 is a semi-schematic longitudinal cross section of another embodiment of water heater.

A power-vented water heater is illustrated in FIG. 4. In this embodiment air is introduced to a porous ceramic surface combustion burner 51 by a power blower 52. The air entering the system first flows over fins of an air-cooled heat sink 53 for cooling a bank of photovoltaic cells 54 surrounding the burner. In this way none of the waste energy from the photovoltaic cells is lost at the system, but instead acts to preheat the incoming air.

After flowing past the cell heat sink 53, the incoming air splits into two parallel paths. One path takes the inlet air past a quartz or glass infrared filter 56 between the burner and the photovoltaic cells. The quartz removes infrared radiation from the surface of the burner for minimizing heating of the photovoltaic cells and the flowing air removes the heat from the quartz.

The second part of the air stream passes through a venturi 57 where fuel gas is mixed with the incoming air en route to the inside of the surface combustion burner. The air-fuel mixture which passes through the porous surface of the burner is ignited by an intermittent pilot 58 which is ignited, as required, by an electric intermittent ignition device 59. The mixture burns near the surface of the porous burner, causing the surface to emit radiation.

The emitted high energy photons from the surface of the burner pass through the quartz infrared filter 56 and most are converted to electron-hole pairs which provide electric power from the photovoltaic cells. The combustion products from the burner and the air passing the infrared filter are mixed and pass upwardly through heat exchange tubes 61 en route to the water heater vent 62. Heat from the combustion gases heats water in an insulated tank 63. A pressure relief valve 64 protects the system from overpressurization. Some energy is transferred from the burner directly to the lower part of the water tank by direct thermal radiation from the burner surface.

A typical power-vented water heater requires approximately forty watts of blower power. Since the typical burner for such an appliance is rated at about 40,000 BTU per hour, only about ½% of the total energy must be converted to electricity to power the blower and controls, and to recharge a battery for use during start-up of the system.

Figure 5:
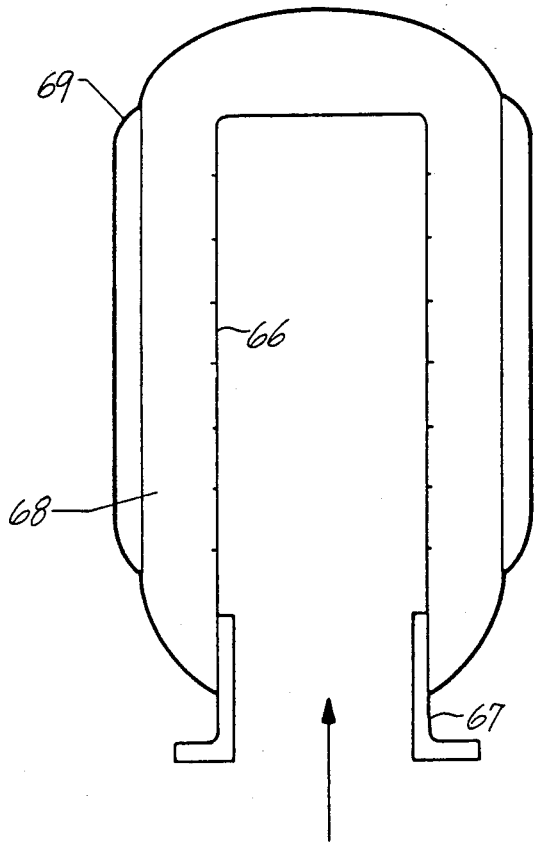
FIG. 5 illustrates an exemplary porous ceramic surface combustion burner for use in a self-powered gas-fired appliance.

High emitter efficiency is obtained from a porous ceramic surface combustion burner such as illustrated in FIG. 5. In an exemplary embodiment particularly useful in practice of this invention, such a burner is fabricated on a metal screen supporting structure 66 on a pipe fitting 67. Any type of flanged or threaded fitting, for example, may be used for mounting the burner and introducing a fuel-air mixture to its hollow interior. A porous mat of ceramic fibers 68 is deposited on the metal screen. An outer layer 69 of ceramic fibers is formed over the principal body of ceramic fibers.

Such a body of fibers is made by drawing liquid through the fitting with the screen immersed in a slurry of ceramic fibers. This builds up a mat of fibers on the exterior of the screen. When a suitable layer or layers of fibers have been deposited, the mat is carefully dried and heated to a sufficient temperature for sintering the intersections between adjacent fibers. The result is a ceramic body having a porosity determined by the fiber geometry and sintering temperature.

The principal mat 68 of fibers used for fabricating the porous ceramic burner can be any of a variety of materials such as alumina, mullite, or the like. Preferably the outer layer of fibers comprises a rare earth metal oxide or ceramic containing such an oxide to act as a thermally stimulated, narrow band, quantum emitter. A mix of different fiber types may also be used. A particularly preferred material comprises ytterbium oxide. Ytterbia is a narrow band emitter which emits photons over a range of energies with a half band width of 50 to 100 nanometers centered about 950 to 1000 nanometers. Other rare earth metal oxides which may be usable in practice of this invention include erbium oxide, holmium oxide, thulium oxide, yttrium oxide, and dysprosium oxide.

Fiber matrix burners have been made in sizes ranging from about 4 centimeters diameter by 10 centimeters long to about a third of a meter in diameter and 3 meters long. Flat plates and other shapes may also be formed. In such a burner the fuel air mixture introduced to the interior passes through the porous matrix of the burner to a combustion front in the burner, typically near the outer surface of the burner. The resulting combustion maintains the external surface of the burner at an elevated temperature while the inferior remains below the combustion temperature due to flowing gas.

Because of the elevated surface temperature, a high radiant heat flux is obtained from the surface. For a maximizing electric power conversion, it is desirable to employ a ceramic having a tuned narrow band emission spectrum rather than a simple black body emitting surface. Preferably the emitter surface comprises a rare earth metal oxide having an emission spectrum matched to the absorption spectrum of the photovoltaic cells employed for converting the radiation to electricity. The rare earth metal oxides emit radiation in a characteristic band of wavelengths when heated to a sufficient temperature.

Thermally stimulated quantum emitting substances have been employed for almost 100 years in ceramic mantels for gas lights. Thoria included in such mantels emits a broad band spectrum of white light used for illumination. It has also been suggested that narrow band emitters are suitable for electric power production. It has been stated that the spectral emittance of ytterbium oxide is particularly well suited for use with silicon photovoltaic cells in a power production system. The photovoltaic conversion efficiency obtained when using an emitter that emits narrow band radiation can be much greater than that obtained using black body radiation.

The reason for this improvement in conversion efficiency is that the energy required to promote an electron from the conduction band to the valance band in the photovoltaic material is equal to some specific quantity, namely the band gap energy. For each photon of sufficient energy absorbed, one electron is promoted into the conduction band. If the photons absorbed have energy in excess of the band gap energy, the excess energy is converted into heat or phonons, and this decreases conversion efficiency. Similarly, if the energy of the photon is too low, it may be absorbed with only production of heat, and no generation of electricity.

Most hot materials emit photons with energies ranging over a broad band which essentially covers the entire energy spectrum. The energy or wavelength at which the photons are emitted is determined by the temperature of the body. With a selective emitter such as a rare earth metal oxide, most of the photon emission occurs at specific energies which are not directly related to the actual temperature of the body. A selective emission material requires less input energy to attain a given temperature because it loses most of its energy by emitting photons only in a narrow wavelength range. When a material with a narrow emission spectrum is coupled to a photovoltaic cell whose conversion characteristics are closely matched to that spectrum, the cell converts the emitted photons to electricity at very high efficiency.

When the material which emits as a black body is heated to 1400° C., only 4.5% of the total energy emitted can participate in the conversion mechanism which produces electricity in a silicon photovoltaic cell. It is possible to heat a black body to 2000° C. and higher, but operation at these high temperatures limits the practical use of such devices. On the other hand, it appears that at least 50% of the total energy emitted at 1400° C. from an ytterbia emitter is in the energy range that can participate in a photovoltaic conversion process with high efficiency. Thus, it is desirable to employ mixed ytterbium oxide and aluminum oxide fibers or fibers formed of a mixture of ytterbia and alumina in at least the outer layer 69 of a fiber matrix burner. Such surfaces do not emit significant radiation in the far- and mid-infrared region and may therefore reach high temperatures at a reasonable heat input rate.

When photons emitted from the burner surface strike a photovoltaic cell, the photons which have energies greater than the band gap energy are absorbed by the cell material and impart enough energy to an electron so that the electron can be elevated from the valance band to the conduction band. This causes current to flow in the external circuit. If, on the other hand, the energy of the photon is less than the band gap, it will either pass through the cell material or, if absorbed, it will not have enough energy to elevate an electron to the conduction band and will result only in the deposition of energy in the cell material in the form of heat.

There are two types of photocell materials with different intrinsic absorption processes. There are those with direct band gap transitions and those with indirect band gap transitions. When a photon is absorbed in a direct band gap material, the energy of the photon is conserved in the electron. In an indirect band gap material, however, both an electron and several phonons are produced when the photon energy is near the band gap, and therefore the interaction does not result in all of the energy being conserved in the electron. The energy which is not conserved is deposited in the cell material in the form of heat. Both direct and indirect band gap materials act in a conservation manner when the incident photon energy is well above the band gap. It is preferred to employ direct band gap materials with the absorption band matched to the emission band of the emitter.

The efficiency with which the photons that leave an emitting surface are converted to electricity depends on the match between the spectral emission of the emitter and the quantum conversion efficiency of the photovoltaic cell. The maximum conversion efficiency is obtained if the emission spectrum is as close to the cell material band gap edge as possible, because it is the photons with energy nearest the band gap edge that are converted most efficiently. With direct band gap materials, the efficiency at which the photons are converted to electron-hole pairs reaches a maximum very quickly. With indirect band gap cells, the quantum conversion efficiency essentially starts at zero at the band gap energy and increases to a maximum at some higher energy.

Figure 7:
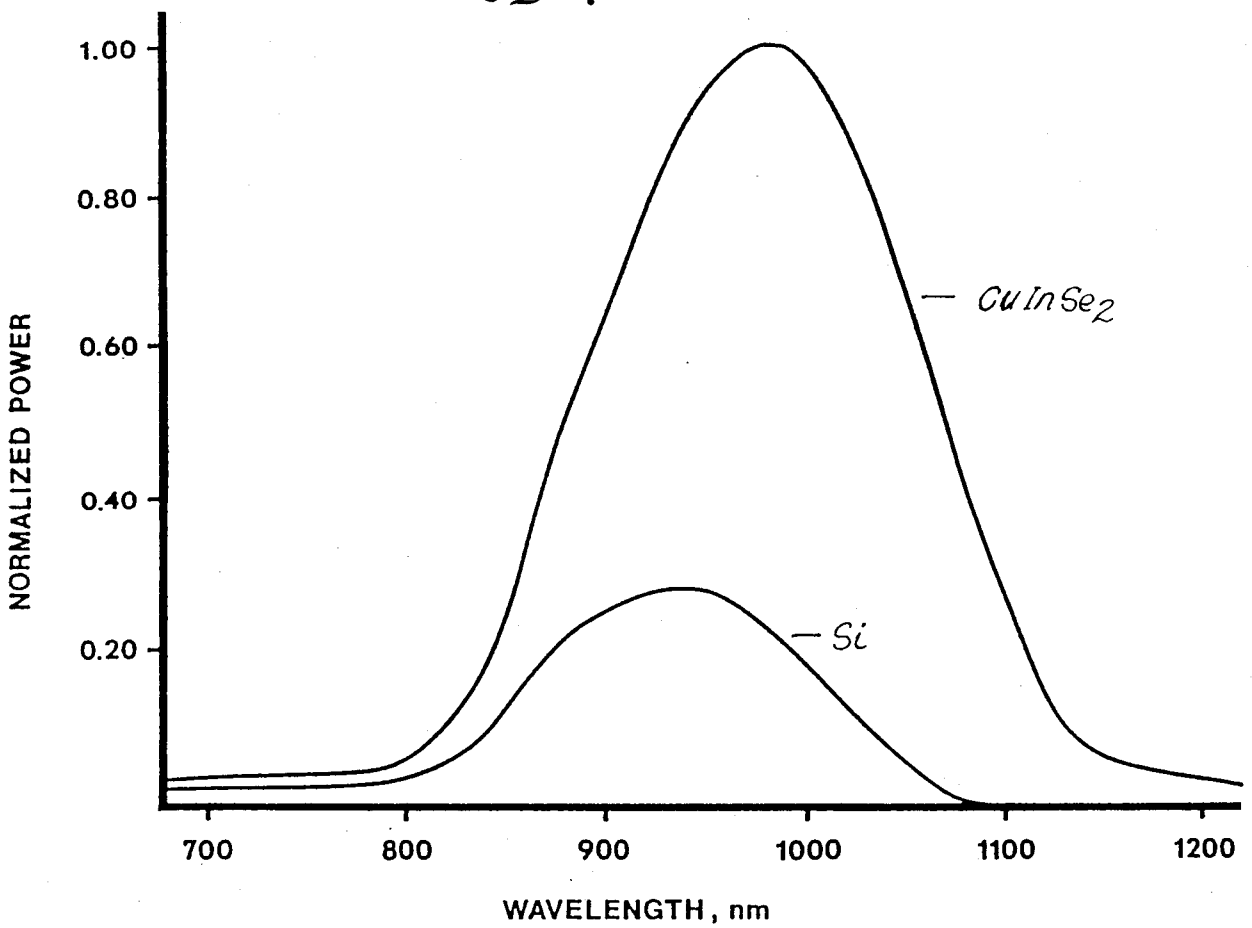
FIG. 7 is a graph of power a a function of wavelength for two types of photovoltaic cells.

FIG. 7 indicates the amount of electrical energy which can be obtained from the emission spectrum of ytterbia with silicon photovoltaic cells (an indirect band gap material) and copper-indium-diselenide cells (a direct band gap material). A normalized power curve is illustrated for each material. These curves were obtained by multiplying the spectral emission of ytterbia by the quantum conversion efficiency of the cell at a number of different energies. The curves were then normalized to the maximum value of the product. The areas under the resulting curves are proportional to the power output which may be obtained using these cells for converting photons being emitted from an ytterbia emitter. The ratio of areas under the two curves is more than 3.5 to 1, indicating the improvement in power which may be obtained using copper-indium-diselenide photovoltaic cells instead of crystalline silicon cells.

Figure 6:
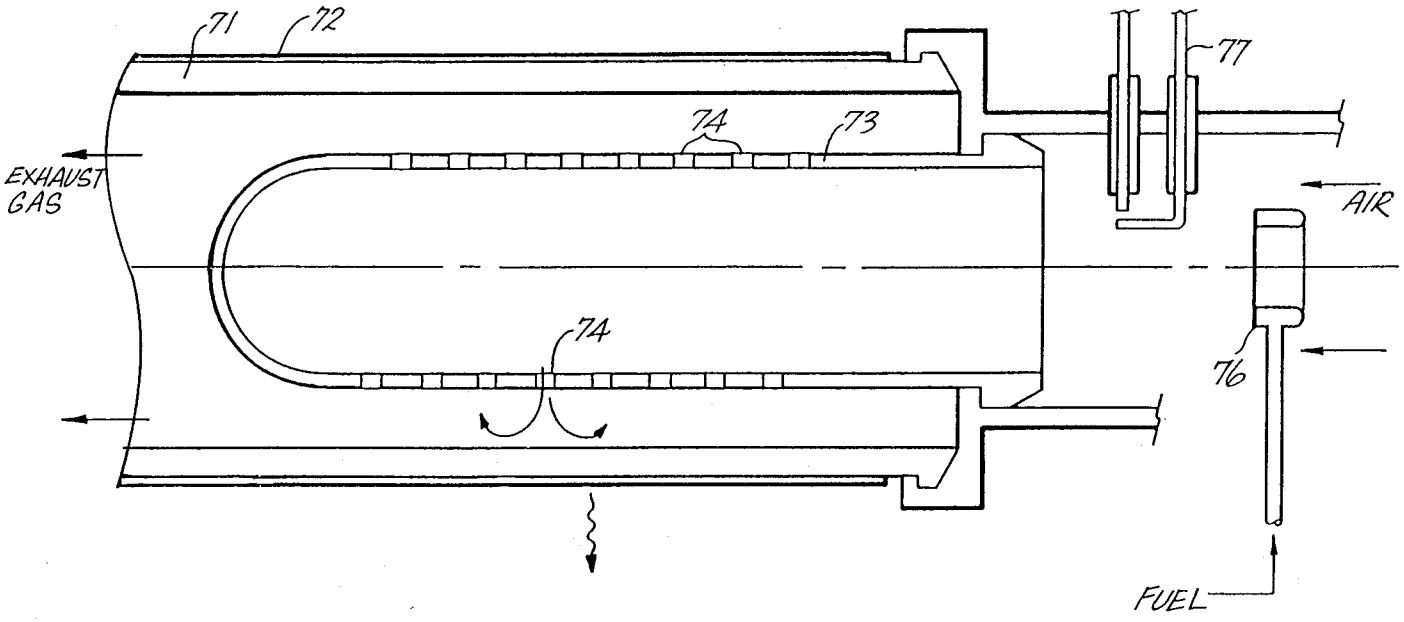
FIG. 6 illustrates in schematic longitudinal cross section another embodiment of burner for such an appliance.

FIG. 6 illustrates in schematic longitudinal cross section a solid ceramic emitter which may be used in an embodiment such as illustrated in FIGS. 1 or 2 for example. In this embodiment there is an outer ceramic tube 71 fabricated of a high temperature resistant material such as silicon nitride. An outer layer 72 of a quantum emitting substance such as a ceramic containing ytterbium oxide is formed on the exterior of the ceramic tube. An internal ceramic jet tube 73 is mounted concentrically from one end of the outer tube. A plurality of holes 74 through the wall of the jet tube permit gas flow from the interior for direct impingement on the outer ceramic tube.

Air, which may be preheated, is introduced to the open end of the jet tube. A fuel injector 76 introduces fuel gas which burns with the air when ignited by a spark igniter 77. In an exemplary embodiment where the air is preheated to about 1100° C., a flame temperature within the jet tube of 1800° C. may prevail. Exhaust gas temperature downstream from the jet tube may be as high as 1500° C. with rapidly decreasing temperature as heat is transferred to incoming air, water, or the like.

Figure 8:
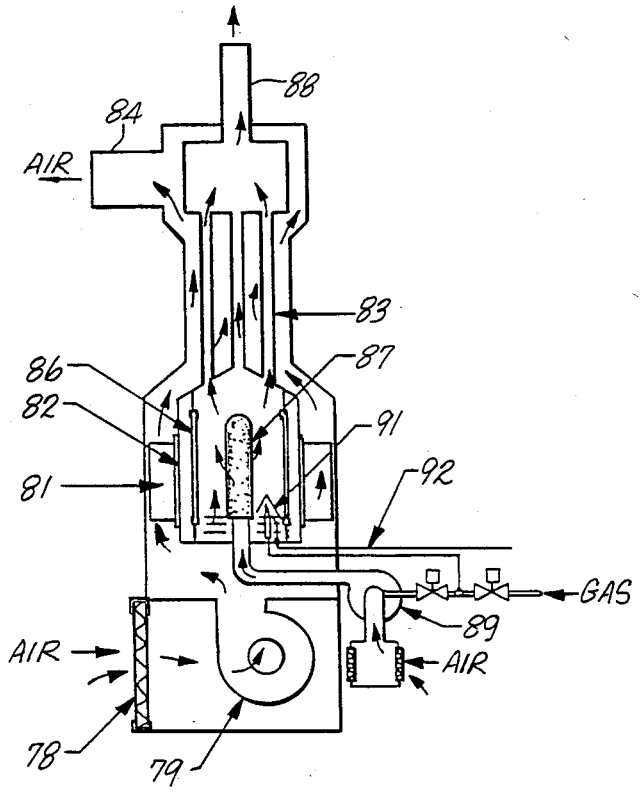
FIG. 8 illustrates in schematic cross section an exemplary self-powered furnace or space heater.
Figure 9:
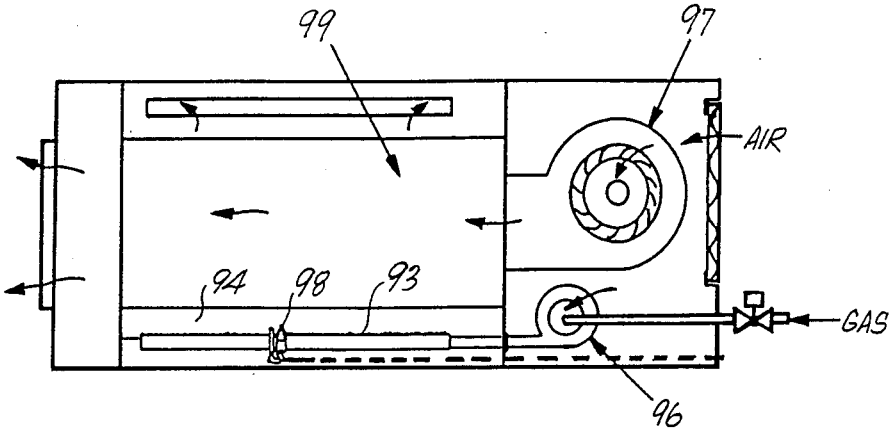
FIG. 9 illustrates in schematic cross section a horizontal embodiment of self-powered gas-fired furnace.
Figure 10:
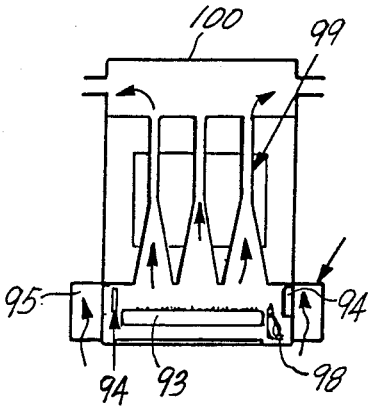
FIG. 10 is a transverse schematic cross section of the furnace of FIG. 7.

FIGS. 8 to 10 illustrate embodiments of selfpowered gas appliances useful for space heating. The hot air furnace illustrated in FIG. 8 has a generally vertical configuration while that illustrated in FIGS. 9 and 10 is generally horizontal, thus being suitable for use in installations having different geometry requirements.

Air enters the vertical embodiment through a conventional filter 78 and is driven by a room air blower 79. Most of this air passes upwardly past heat sink fins 81 for cooling photovoltaic cells 82 surrounding the combustion chamber of the furnace. This portion of the air passes over heat exchange surfaces 83 and exits through a hot air duct 84. A portion of the cool inlet air is also introduced through the bottom of the combustion chamber to flow upwardly past infrared filters 86 which absorb longer wavelength radiation as hereinabove described. This cooling air for the filters commingles with the combustion products from a porous ceramic fiber matrix burner 87 as hereinabove described before passing through the heat exchanger 83 and out of a furnace vent 88.

Filtered air is applied to the interior of the porous surface combustion burner by a burner blower 89. Fuel gas is also introduced for combustion. The gas is also provided to an ignition mantel 91 which is ignited as required by a high voltage spark igniter 92.

Generally speaking, the vertical furnace operates much as hereinabove described for a water heater. The inlet air serves to cool the photovoltaic cells for optimum efficiency. This, of course, also preheats the air which is further heated in the heat exchanger. Electric power for the blowers and igniter are provided by the thermophotovoltaic cells. The fiber matrix burner in this embodiment has two wide flat sides facing the photovoltaic cells arrayed along each wall of the combustion chamber. The curved ends and top of the burner may be porous or nonporous, as desired, for supporting combustion over the entire surface or limiting it to the flat sides facing the photovoltaic cells.

The burner 93 in a horizontal furnace arrangement as illustrated in FIGS. 9 and 10 is in the form of a flat plate fiber matrix which is nonporous on its bottom surface, and porous on its side and top surfaces. The fibers along at least the two long edges of the burner include a thermally stimulated quantum emitter substance such as a rare earth metal oxide for emitting narrow band radiation matched to the absorption spectrum of photovoltaic cells arrayed along opposite sides of the combustion chamber. Cooling fins 95 along each side of the furnace help keep the cells relatively cool by natural or forced convection.

If desired infrared filters may be provided for minimizing overheating of the photovoltaic cells. Combustion air and fuel gas are supplied to the burner by way of a burner blower 96 at one end of the furnace. The burner blower is separate from the room air blower 97 since a somewhat higher pressure is required inside the burner than outside. The burner is ignited by a conventional pilot 98.

Combustion gas from the burner flows upwardly through a plate heat exchanger 99 into an exhaust plenum 100 from which it is vented. Room air from the blower 97 passes horizontally through the heat exchange section 99 to a hot air plenum 101 where it is recirculated into the space to be heated.

In either of the hot air furnaces, electric power for the blowers is provided by the photovoltaic cells. A rechargeable battery (not shown) is used to provide power for the starting sequence which may have a short term peak power demand five or six times the steady state power requirement. The thermophotovoltaic cells are sized so that they can recharge the battery during a moderate period of furnace operation.

Figure 11:
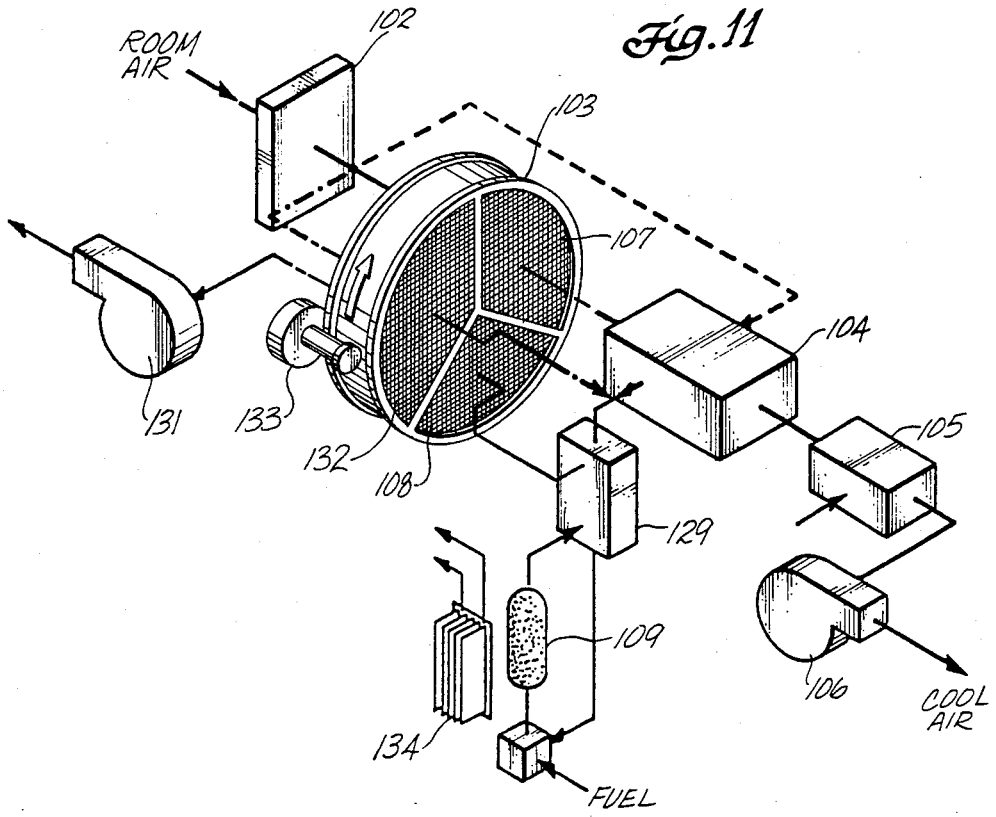
FIG. 11 is a schematic illustration of a gas-powered desiccant wheel air conditioning system.

FIG. 11 illustrates schematically a gas powered desiccant wheel absorption cycle air conditioning system. Warm moist air enters the system through a filter 102 for removing atmospheric dust and the like. It then passes through a rotatable desiccant wheel 103 where moisture in the air is removed. The process of removing the moisture from the air causes it to warm somewhat. The warm dry air passes through an aftercooler 104 where it is cooled by passage of a portion of somewhat cooler inlet air. This cools the air exiting the desiccant wheel to a temperature only a few degrees above the inlet air.

Moisture is then added to the air exiting the aftercooler by a humidifier 105. The addition of moisture to the dried air decreases the temperature considerably and brings the moisture level into the comfort zone. The cooled moist air is then blown into the room by a blower 106. The moisture level in the room is controlled by the amount of water added by the humidifier.

The desiccant wheel is divided into three sectors used sequentially. A portion of the inlet air passes through a drying sector 107 where moisture is removed from the inlet air. The desiccant wheel is recharged by expelling water in a heated sector 108. A temperature in the range of from 175° to 225° C. (depending on the desiccant material used in the wheel) drives off the moisture accumulated in the desiccant in the drying sector. The heating is by way of exhaust products from a surface combustion burner 109 as hereinabove described. These exhaust gases pass through a heat exchanger 129 en route to the heating sector 108 of the wheel, and vents to a powered vent blower 131.

A portion of the inlet air passes through a cooling sector 132 en route to the heat exchanger 129. This cooling air is commingled with the air from the aftercooler and preheated in the heat exchanger to serve as inlet air to the burner. The cooling air cools the recharged desiccant from its highest temperature to a temperature where it begins to remove water vapor from the inlet air.

The desiccant wheel is rotated by an electric motor 133 so that each sector of the wheel cycles through the three stations for drying, heating and cooling respectively.

There are four requirements for electric power in this system. Besides the power required to rotate the desiccant wheel, there are the wheel regeneration blower and the room air blower. The fourth is the power required for control. The steady state electric power requirements for a typical four ton air conditioning system is in the order of 500 watts. The start-up power requirement for the motors is somewhat higher, however, the control system is designed so that the start-up is sequential. In such a case the peak electric load does not exceed about 650 watts at any time during the start-up cycle. Further, the peak power requirement occurs only after significant power is being produced by a bank of photovoltaic cells 134 illuminated by radiation from the burner, as hereinabove described. This tends to minimize the power required for a start-up battery for running the system.

Thermal input to a well-designed desiccant air conditioning system is about 5800 BTU/hr. This thermal output requires a system thermal to electric conversion efficiency of about 3.6% to provide the necessary output power to handle steady state power requirements. Since the conversion efficiency attainable from photovoltaic conversion is several times higher than 3.6%, there is adequate power for recharging the start-up power source during the running cycle.

Although a limited number of embodiments of self-powered, gas-fired appliances have been described and illustrated herein, it will be apparent that many modifications and variations can be made. Thus, the specific arrangements of the parts for water heaters, steam-electric cogeneration systems, space heaters, air conditioning systems, and the like may differ appreciably from the embodiments illustrated herein. It is, therefore, to be understood that within the scope of the appended claims the invention may be practiced otherwise than as specifically described.

What is claimed is:

1. A completely self-powered gas appliance comprising:

a gas burner having an emissive surface which includes a substance that emits quantum radiation when thermally stimulated;

blower means for supplying combustion air to the burner;

means for supplying fuel gas to the burner for combustion and heating of the emissive surface;

photovoltaic means for converting radiation from the emissive surface into electric power;

means for operating the blower with electric power from the photovoltaic means with no other source of electric power being required; and means for transferring heat from the combustion products to a utility fluid.

2. A self-powered gas appliance as recited in claim 1 further comprising means for removing heat from the photovoltaic means with at least a portion of the utility fluid.

3. A self-powered gas appliance as recited in claim further comprising radiation filter means between the emissive surface and the photovoltaic means for removing at least a portion of longer wavelength radiation from the radiation and passing shorter wavelength radiation to the photovoltaic means.

4. A self-powered gas appliance as recited in claim 3 further comprising means for air cooling the filter means.

5. A self-powered gas appliance as recited i claim 1 wherein the burner comprises a ceramic porous surface combustion burner including a rare earth metal oxide.

6. A self-powered gas appliance as recited in claim 1 wherein the utility fluid comprises water and at least a portion of the water is preheated by removing heat from the photovoltaic means.

7. A self-powered gas appliance as recited in claim 1 wherein the absorption spectrum of the photovoltaic means is matched to the emission spectrum of the thermally stimulated quantum emitting substance.

8. A self-powered gas appliance as recited in claim 7 wherein the quantum emitting substance comprises ytterbium oxide, and the photovoltaic means comprises copper indium diselenide.

9. A self-powered gas appliance as recited in claim 1 wherein the photovoltaic means comprises a direct band gap material.

10. A self-powered gas appliance as recited in claim 1 wherein the combustion air is preheated by heat exchange with combustion exhaust gas.

11. A self-powered gas appliance as recited in claim 1 wherein the burner comprises a flat porous ceramic through which fuel gas and air flow for combustion adjacent to a surface of the ceramic.

12. A self-powered gas appliance as recited in claim 1 wherein the utility fluid comprises space heating air and at least a portion of the space heating air is preheated by removing heat from the photovoltaic means.

13. A self-powered gas appliance as recited in claim 12 comprising a room blower for circulating space heating air through the appliance in heat exchange relation with the combustion products, and means for operating the room blower with electric power from the photovoltaic means.

14. A self-powered gas appliance as recited in claim 1 comprising a desiccant wheel for drying air, and wherein the utility fluid comprises air passed through desiccant in the wheel for recharging the desiccant.

15. A self-powered gas appliance as recited in claim 1 comprising a desiccant wheel absorption cycle air conditioning system.

16. A gas-fired cogeneration appliance for modifying temperature of a utility fluid and generating sufficient electric power for self contained operation comprising:

a ceramic burner including a rare earth metal oxide for emitting narrow band radiation when the burner is heated;

photovoltaic conversion cells arrayed for illumination by such narrow band radiation and having a conversion spectrum matched to the emission spectrum of the rare earth metal oxide;

a heat exchanger for heating a utility fluid with exhaust gas from the burner; and electrically powered means for circulating fluid through the appliance; and wherein the burner and photovoltaic cells provide at least sufficient electric power for operating the appliance with no other source of electric power being required.

17. A gas-fired appliance as recited in claim 16 wherein the means for circulating fluid includes a blower for circulating air to at least the burner.

18. A gas-fired appliance as recited in claim 17 comprising means for cooling the photovoltaic cells and means for circulating air to the means for cooling.

19. A gas-fired appliance as recited in claim 16 wherein the burner comprises a porous ceramic surface combustion burner.

20. A gas-fired appliance as recited in claim 19 wherein the burner includes fibers on at least its outer surface comprising ytterbium oxide.

21. A gas-fired appliance as recited in claim 16 wherein the utility fluid comprises water, and at least a portion of the water is preheated by removing heat from the photovoltaic cells.

22. A gas-fired appliance as recited in claim 16 comprising a desiccant wheel absorption cycle air conditioning system.

23. A gas-fired appliance as recited in claim 16 comprising infrared filter means between the burner and the photovoltaic cells for absorbing at least a portion of infrared radiation and means for passing air past the filter for extracting heat.

24. A gas-fired appliance as recited in claim 16 further comprising means for removing heat from the photovoltaic means with at least a portion of the utility fluid.

25. A gas-fired appliance as recited in claim 16 wherein the rare earth metal oxide comprises ytterbium oxide, and the photovoltaic cells comprise copper indium diselenide.

* * * * *